US009343258B2

(12) United States Patent
Reuber

(10) Patent No.: US 9,343,258 B2
(45) Date of Patent: May 17, 2016

(54) MAGNETIC ACTUATOR FOR A CIRCUIT BREAKER ARRANGEMENT

(71) Applicant: ABB Technology AG, Zürich (CH)

(72) Inventor: Christian Reuber, Willich (DE)

(73) Assignee: ABB TECHNOLOGY AG, Zürich (CH)

( * ) Notice: Subject to any disclaimer, the term of this patent is extended or adjusted under 35 U.S.C. 154(b) by 0 days.

(21) Appl. No.: 13/784,488

(22) Filed: Mar. 4, 2013

(65) Prior Publication Data

US 2013/0187734 A1 Jul. 25, 2013

Related U.S. Application Data

(63) Continuation of application No. PCT/EP2011/004429, filed on Sep. 2, 2011.

(30) Foreign Application Priority Data

Sep. 4, 2010 (EP) ..... 10009199

(51) Int. Cl.

*H01F 7/08* (2006.01)
*H01H 77/06* (2006.01)
*H01H 50/16* (2006.01)
(Continued)

(52) U.S. Cl.

CPC ..... *H01H 77/06* (2013.01); *H01F 41/00* (2013.01); *H01H 50/163* (2013.01); *H01H 51/2209* (2013.01); *H01H 33/6662* (2013.01); *H01H 50/20* (2013.01); *Y10T 29/4902* (2015.01)

(58) Field of Classification Search

CPC ..... H01F 5/02; H01F 7/06; H01F 7/08
USPC ..... 335/250, 233, 281, 282
See application file for complete search history.

(56) References Cited

U.S. PATENT DOCUMENTS 1,034,397 A * 7/1912 Soldatencow ..... 361/206
1,585,630 A * 5/1926 Carpenter et al. ..... 335/276
(Continued)

FOREIGN PATENT DOCUMENTS

EP 1 383 144 A1 1/2004
EP 1 843 375 A1 10/2007
WO WO 98/22965 A1 5/1998

OTHER PUBLICATIONS

International Search Report (PCT/ISA/210) issued on Dec. 5, 2011, by the European Patent Office as the International Searching Authority for International Application No. PCT/EP2011/004429.
(Continued)

*Primary Examiner* — Alexander Talpalatski
(74) *Attorney, Agent, or Firm* — Buchanan Ingersoll & Rooney PC

(57) ABSTRACT

An exemplary magnetic actuator for a circuit breaker arrangement includes a coil, a core with a groove for accommodating a section of the coil, and a movable plate configured to be attracted by the core. When a magnetic field is generated by the coil, the movable plate actuates the circuit breaker arrangement based on the attraction to the core. The magnetic actuator also includes a position locker for locking the coil in the groove. The position locker having a locking part protruding away from the core and over a section of the coil not accommodated in the groove.

20 Claims, 3 Drawing Sheets

(51) Int. Cl.

| | |
|---|---|
| ***H01H 51/22*** | (2006.01) |
| ***H01F 41/00*** | (2006.01) |
| *H01H 33/666* | (2006.01) |
| *H01H 50/20* | (2006.01) |

(56) References Cited

U.S. PATENT DOCUMENTS

| | | | | | |
|---|---|---|---|---|---|
| 1,998,810 | A | * | 4/1935 | Getchell | 335/275 |
| 2,159,837 | A | * | 5/1939 | Babb et al. | 335/155 |
| 2,305,415 | A | * | 12/1942 | Goff | 335/261 |
| 2,351,377 | A | * | 6/1944 | Warsher | 335/276 |
| 2,427,826 | A | * | 9/1947 | Warsher | 335/281 |
| 2,937,322 | A | * | 5/1960 | Nixon | 335/281 |
| 4,137,514 | A | * | 1/1979 | Wright et al. | 335/220 |
| 4,586,013 | A | * | 4/1986 | Linkner, Jr. | 335/276 |
| 5,376,910 | A | * | 12/1994 | Geringer et al. | 335/278 |
| 5,449,059 | A | * | 9/1995 | Wohlrab | 194/346 |
| 5,781,089 | A | | 7/1998 | Doneghue | |
| 5,990,770 | A | | 11/1999 | Doneghue | |
| 6,157,277 | A | * | 12/2000 | Bulgatz et al. | 335/220 |
| 6,816,048 | B2 | * | 11/2004 | Morita et al. | 335/220 |
| 2008/0272659 | A1 | | 11/2008 | Jeong et al. | |
| 2009/0039989 | A1 | | 2/2009 | Reuber | |

OTHER PUBLICATIONS

Written Opinion (PCT/ISA/237) issued on Dec. 5, 2011, by the European Patent Office as the International Searching Authority for International Application No. PCT/EP2011/004429.

European Search Report for EP 10009199 dated Jan. 27, 2011.

* cited by examiner

MAGNETIC ACTUATOR FOR A CIRCUIT BREAKER ARRANGEMENT

RELATED APPLICATION(S)

This application is a continuation application under 35 U.S.C. §120 to International Application PCT/EP2011/004429 filed as an on Sep. 2, 2011 designating the U.S., and claiming priority to European Application EP 10009199.0 filed in Europe on Sep. 4, 2010. The content of each prior application is hereby incorporated by reference in its entirety.

FIELD

The disclosure relates to a magnetic actuator for a circuit breaker arrangement, a method of assembling a magnetic actuator, the usage of a magnetic actuator and a circuit breaker arrangement.

BACKGROUND INFORMATION

For the operation of a circuit breaker, such as a medium voltage vacuum circuit breaker, it can be necessary to generate a high force to press a first moving electrical contact to a second corresponding fixed electrical contact. The force can be generated by a magnetic actuator. Therefore, the magnetic actuator comprises a coil for generating an electrical field, a core for forming this field and a movable plate which is attracted by the core. When attracted by the core, the movable plate generates the force used for actuating the circuit breaker.

In an open position, the movable plate can be away from the core such that a gap (which can be filled by air) is formed. The coil moves towards the movable plate and intrudes into the air gap, which can lower or even prevent the operating ability of the device. Normally, the intrusion into the gap can be avoided by one or more grooves in the coil-facing sides of the core and the flanks of the core, so that a locking piece can be interposed into these grooves. The locking piece or locking part can be a stopper or stopping means for the movement of the coil towards the gap.

EP1843375A1 shows an electromagnetic actuator for a medium voltage circuit breaker with an actuator having an electromagnet exhibiting a magnet core with a rectangular profile, and a round upper yoke corresponding to the electromagnet.

US2008272659 A1 shows an electromagnetic force driving actuator and a circuit breaker using the same.

The design with grooves and locking pieces can reduce the usable space for the coil, thus reducing the potential efficiency of the device. If the coil space is to be kept constant, the height of the core and the flanks can have to be increased, thus increasing the undesired stray flux of the magnet, and also increasing the overall dimensions of the device. Further, such grooves can increase the magnetic resistance in the core and the flanks. In this case, the grooves can disturb the distribution of the magnetic flux close to the air gap, jeopardising the flux concentration. Both actions can result in a reduced holding force.

SUMMARY

An exemplary magnetic actuator for a circuit breaker arrangement is disclosed, the magnetic actuator comprising: a coil; a core with a groove for accommodating a section of the coil; a movable plate configured to be attracted by the core such that when a magnetic field is generated by the coil, the movable plate actuates the circuit breaker arrangement based on the attraction to the core; and a position locker for locking the coil in the groove, wherein the position locker has a locking part protruding away from the core and over a section of the coil not accommodated in the groove.

An exemplary method of assembling a magnetic actuator for a circuit breaker arrangement is disclosed, the method comprising: setting a coil into a groove of a core of the magnetic actuator, such that a section of the coil is accommodated in the groove; pushing a position locker between the coil and the core, such that a locking part of the position locker protrudes away from the core and over the coil at a section of the coil not accommodated in the groove; and attaching a connection part of the position locker to the core, such that the coil is prevented from leaving the groove by the locking part.

An exemplary circuit breaker arrangement is disclosed comprising: at least one magnetic actuator including: a coil; a core with a groove for accommodating a section of the coil; a movable plate configured to be attracted by the core such that when a magnetic field is generated by the coil, the movable plate actuates the circuit breaker arrangement based on the attraction to the core; and a position locker for locking the coil in the groove, wherein the position locker has a locking part protruding away from the core and over a section of the coil not accommodated in the groove; and a first electrical contact and a second electrical contact, wherein the at least one magnetic actuator is mechanically connected to the first and second electrical contacts, such that, when moving, the movable plate actuates the circuit breaker arrangement by connecting or disconnecting the first and second contacts.

BRIEF DESCRIPTION OF THE DRAWINGS

Exemplary embodiments of the present disclosure are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION

Figure 1:
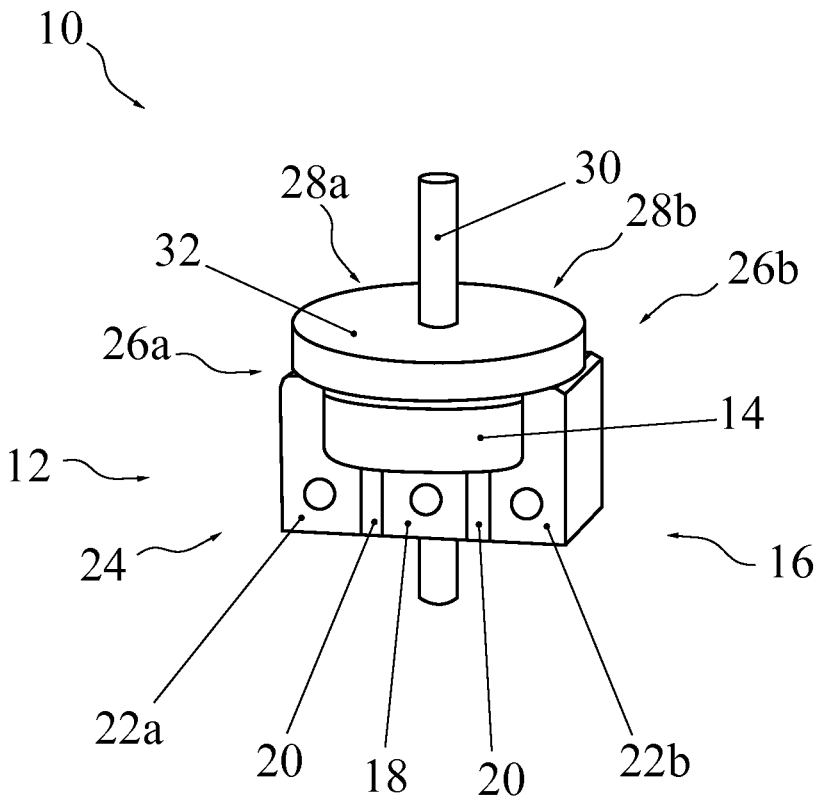
FIG. 1 shows a perspective view of a magnetic actuator according to an exemplary embodiment of the disclosure.

Exemplary embodiments of the present disclosure provide a compact and efficient magnetic actuator, with high operation ability.

The exemplary embodiments described herein relate to a magnetic actuator for a circuit breaker arrangement.

According to an exemplary embodiment of the disclosure, the magnetic actuator comprises a coil and a core with a groove for accommodating a section of the coil and a movable plate being attracted by the core, when a magnetic field is generated by the coil in the core, for example when current passes through the coil. The movable plate can actuate the circuit breaker arrangement, when attracted by the core. This can mean that electrical contacts of the circuit breaker arrangement are opened or closed, when it is actuated.

According to an exemplary embodiment of the disclosure, the magnetic actuator comprises a position locker for locking the coil in the groove. This can mean that the coil remains in the groove even when being attracted by the moving plate. The position locker can have a locking part protruding away from the core and over the coil.

According to an exemplary embodiment of the disclosure the locking part protrudes over a section of the coil not accommodated in the groove, for example a section remote from the groove. When the groove comprises several parts, the locking part can be remote from all parts of the groove.

In other words, the locking part can extend over the coil at a position other than the position the groove is situated at. The position locker being remote can mean that the protruding part may not be situated over the groove or may not cover a part of the groove, when one is looking onto the core in a direction of the movement of the coil.

The protruding part can be a lug holding or catching the coil, such that the coil remains in the groove.

According to an exemplary embodiment of the disclosure, the movement of the movable plate can be guided by an axis that can be attached to the core.

According to an exemplary embodiment of the disclosure, the core can comprise a central part and at least one flank. As a rule, the core has two flanks, a first flank and a second flank, the second flank being opposite to the first flank with respect to the central part. The flank(s) and the central part can be connected by a beam from which the flank(s) and the central part protrude in a comb-like manner. The beam can be formed of parts integrally formed with the flank(s) and the central part.

The groove can be limited by a side of the flank facing the core, a side of the central part facing the flank and a part of the beam. For example, the groove can have a rectangular cross-section.

According to an exemplary embodiment of the disclosure, the position locker is connected to the core with a connection means, for example a screw and a screw thread, also used for connecting the position locker to a further member of the circuit breaker arrangement. This further member can be a housing of the magnetic actuator or a connection cable. The screw thread can already be present in the core and the position locker can have a hole fitting over the hole of the screw thread.

According to an exemplary embodiment of the disclosure, the position locker has a connection part for connecting the position locker to the core.

According to an exemplary embodiment of the disclosure, the connection part and the locking part are orthogonal with respect to each other. This can mean that the connection part and the locking part form an angle of 85° to 95° with respect to each other.

According to an exemplary embodiment of the disclosure, the position locker is L-shaped. For example, the locking part can form a first leg of the L and the connection part can form a second leg of the L.

According to an exemplary embodiment of the disclosure, the position locker is made of a plate-like material, for example sheet plate. The position locker can be made of a strip of sheet plate.

According to an exemplary embodiment of the disclosure, the position locker is integrally formed. This can be understood such that the connection part and the locking are may not be assembled from different parts but can be one single piece.

According to an exemplary embodiment of the disclosure, the position locker is made of steel or a non-magnetic material, for example non-magnetic stainless steel.

According to an exemplary embodiment of the disclosure, the position locker is a first position locker situated at a first side of the core and the magnetic actuator comprises a second position locker situated at a second side of the core, the second side being opposite to the first side. As a rule, the magnetic actuator can have two positions lockers.

The first and second sides can be sides of the central part of the core. Normally, the central part of the core has a rectangular cross-section and the first and second sides are facing in a direction orthogonal to the extension of the beam forming the comb-like structure of the core. Two other sides of the central part form sides of the groove. The first and second sides of the core mentioned above are therefore not sides of the core limiting the groove.

According to an exemplary embodiment of the disclosure, the first and second position lockers can be equally formed or manufactured.

Another exemplary embodiment of the disclosure relates to a method of assembling or manufacturing a magnetic actuator for a circuit breaker arrangement.

According to an exemplary embodiment of the disclosure, the method comprises the steps: putting (e.g., setting) a coil into a groove of a core of the magnetic actuator, such that a section of the coil is accommodated in the groove; pushing a position locker between the coil and the core, such that a locking part of the position locker protrudes away from the core and over the coil remote from the groove.

According to an exemplary embodiment of the disclosure, the method comprises the further step of: attaching or screwing a connection part of the position locker to the core, such that the coil is prevented from leaving the groove by the locking part.

According to an exemplary embodiment of the disclosure, the method comprises the further steps of: pushing a second position locker between the coil and the core at a position opposite to the (first) position locker; attaching the second position locker to the core.

It should be understood that features of the exemplary method as described in the above and in the following can be features of the magnetic actuator as described in the above and in the following and vice versa.

A further exemplary embodiment of the disclosure relates to the usage of a magnetic actuator as described in the above and in the following in a medium voltage vacuum circuit breaker. A medium voltage can be a voltage between 1 kV and 52 kV.

Another exemplary embodiment of the disclosure relates to a circuit breaker arrangement.

According to an exemplary embodiment of the disclosure, the circuit breaker arrangement, comprising at least one magnetic actuator as described in the above and in the following. The circuit breaker arrangement comprises a first electrical contact and a second electrical contact. The magnetic actuator can be mechanically connected to the first and second contacts, such that the movable plate actuates the circuit breaker by connecting or disconnecting the first and second contacts when moving.

These and other exemplary embodiments of the disclosure will be apparent from and elucidated with reference to the exemplary embodiments described hereinafter.

FIG. 1 shows a perspective view of an (electro) magnetic actuator 10 comprising an electromagnet 12 with a coil 14 and a core 16. The core 16 of the magnetic actuator 10 comprises a core element or central part 18, two permanent magnets 20, and two flanks 22*a* and 22*b*. The lower part of the first flank 22*a*, the first permanent magnet 20, the lower part of the central part 18, the second permanent magnet 20, and the lower part of the second flank 22*b* form a beam 24, such that the core has a comb-like structure.

Between the fingers of the comb (e.g., the upper parts of the central part 18 and the flanks 22*a*, 22*b*) two grooves 26*a*, 28*b* are formed. The first (second) groove 26*a* (26*b*) is limited by the inner side of the upper part of the flank 22*a* (22*b*) and a side of the upper part of the central part 18 facing the side of the flank 22*a* (22*b*).

In the first and second grooves 26*a*, 26*b* a first and second section 28*a*, 28*b* of the coil 14 is accommodated. Other sections of the coil 14 protruded over sides of the core in a direction orthogonal to the extension of the beam 24.

An axis 30 for guiding a movable plate 32 extends through a hole in the central part 18 of the core 16. Due to the axis 30, the movable plate 32 can only move towards the core 16 and away from the core 16. When an electrical current runs through the coil 14, a magnetic field is generated in the coil 16 which will attract the moving plate 32. The movable plate 32 can be moved back into the open position by a spring not shown in FIG. 1.

Figure 2:
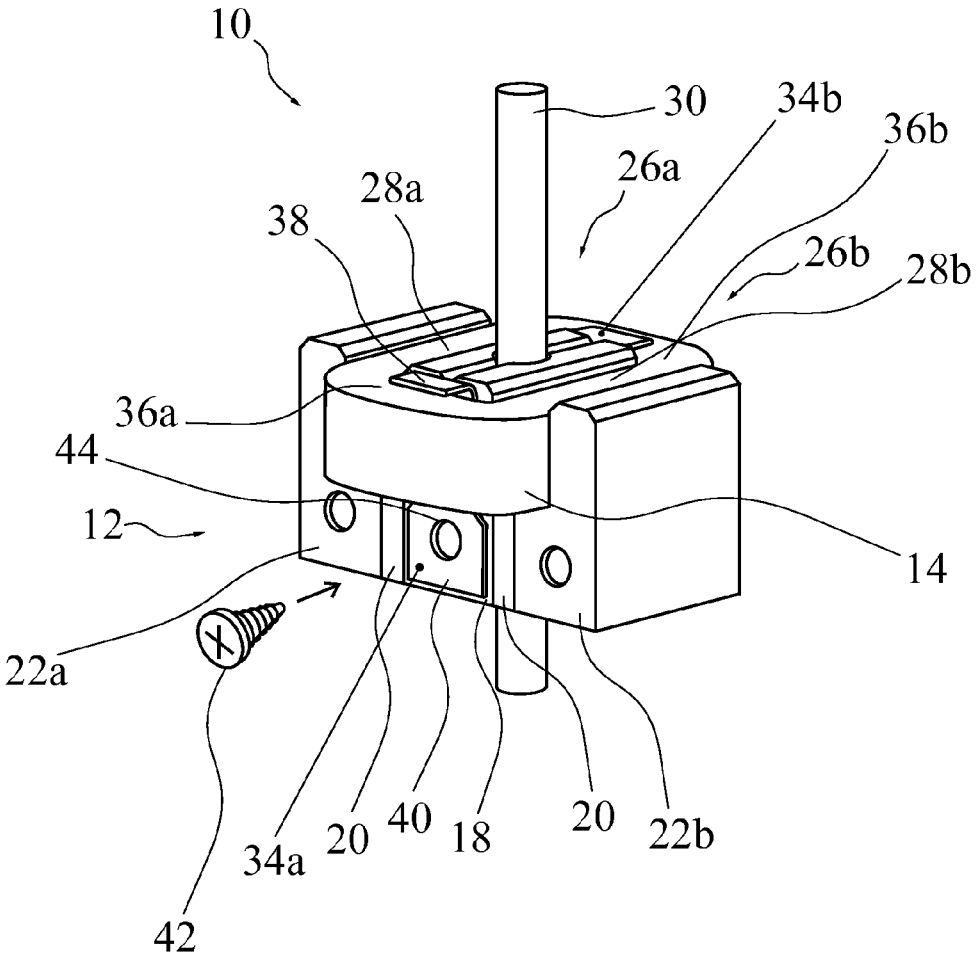
FIG. 2 shows a perspective view of a magnetic actuator according to an exemplary embodiment of the disclosure.

FIG. 2 shows a further exemplary embodiment of a magnetic actuator 10. In FIG. 2, the moving plate 32 is not shown, so that the grooves 26*a*, 26*b* and the sections 28*a*, 28*b* of the coil 14 are easier to be seen. In FIG. 2, two position lockers 34*a*, 34*b* are shown.

The first (second) position locker 34*a* (36*b*) is situated between the central part 18 of the core 12 and a section 36*a* (36*b*) of the coil 14 that is not accommodated in (e.g., outside of) one of the grooves 26*a*, 26*b*. L-shaped coil position lockers 36*a*, 36*b* are used to hold the coil 14 in position.

In the following the functionality of the position lockers 34*a*, 34*b* will be explained with respect to the position locker 34*a*. For holding the coil 14, a first leg 38 or locking part 38 of the position locker 34*a* is protruding over the section 34*a* of the coil 14.

With a second leg of connection part 40, the position locker 34*a* is screwed to the core 12, using a screw 42 that is already present for use in a further purpose. Because of this, the position locker 36*a* has a hole 44 through which the screw 42 can be screwed into a screw thread in the central part 18 of core 12.

The position locker 34*a* extends between the core 12 and the coil 14. The position locker 34*a* is bent about 90° around the coil 14, or the bobbin of the coil, if present, to hold it in position.

In that way, the coil space between the central part 18 of the core 12 and the flanks 22*a*, 22*b* is only reduced very marginally. In the area of the winding heads where the position lockers 34*a*, 34*b* are installed, e.g., outside the core area of the magnetic actuator 10, the coil 14 can be bended downwards (in the sense of the figures) to compensate for the thickness of the locking part 38 of the position lockers 34*a*, 34*b*, so that the coil space in the critical area between the central part 18 of the core 12 and the flanks 22*a*, 22*b* may not be reduced at all.

The position lockers 34*a*, 34*b* can be made of a thin, however strong material, like steel. It can be further advantageous to make the position lockers 34*a*, 34*b* of a non-magnetic material, like certain types of stainless steel.

It can be advantageous to use (exactly) two position lockers 34*a*, 34*b*, one at each side of the core 12. One position locker 34*a* may not hold the coil 14 reliably in a place, and more than two position lockers can be difficult to assemble.

Figure 3:
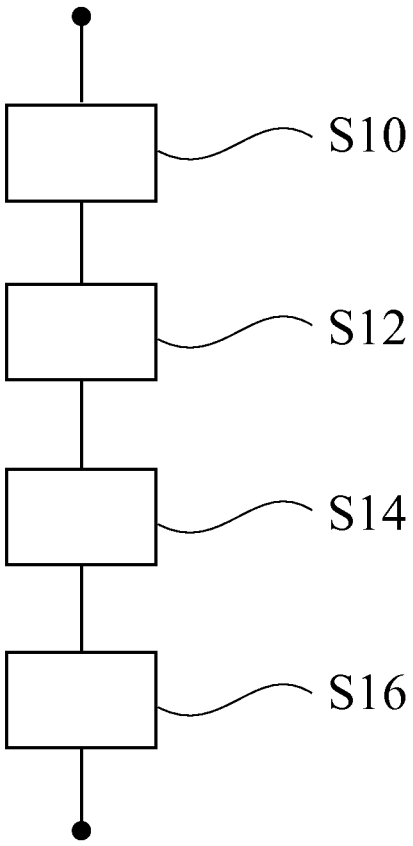
FIG. 3 shows a flow diagram for a method of assembling a magnetic actuator according to an exemplary embodiment of the disclosure.

FIG. 3 shows a flow diagram for a method of assembling the magnetic actuator 10.

In step S10, the coil 14 is put into the grooves 26*a*, 26*b* of the core of the magnetic actuator 10, such that the sections 28*a*, 28*b* of the coil 14 are accommodated in the grooves 26*a*, 26*b*.

In step S12, the position locker 34*a* is pushed between the central part 18 of the core 12 and the section 34*a* of the coil 14. This is done, such that the locking part 38 of the position locker 34*a* protrudes away from the core 12 and over the coil 14 remote from the grooves 26*a*, 26*b*.

In step S14, the connection part 40 of the position locker 34*a* is screwed to the core 12 with the screw 42. Simultaneously, a further part of the magnetic actuator 10 can be screwed to the magnetic actuator 10 with the same screw 42 in this step.

In step S16, steps S12 and S14 can be repeated for the position locker 36*b*. It has to be understood that the two position lockers can also be pushed into the magnetic actuator 10 in a first step, and screwed to the magnetic actuator 10 in a second step.

Figure 4:
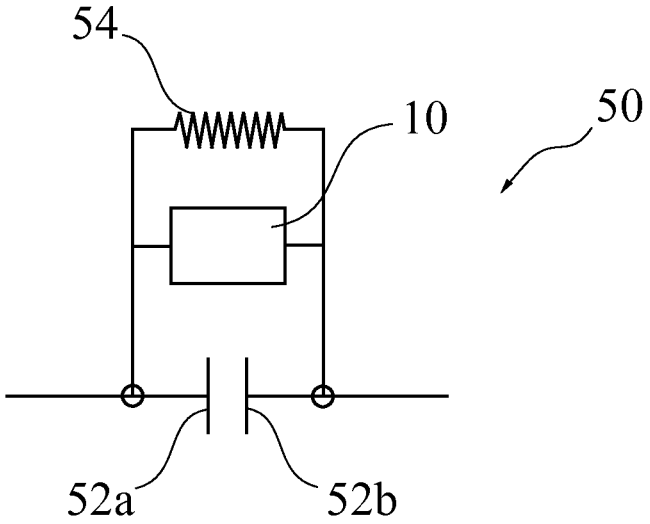
FIG. 4 shows a schematic drawing of a circuit breaker arrangement according to an exemplary embodiment of the disclosure.

FIG. 4 shows a schematic drawing of a circuit breaker arrangement 50. The circuit breaker arrangement 50 comprises two electrical contacts 52*a*, 52*b* that can be electrically connected to lines of a medium voltage grid. Further the electrical contacts 52*a*, 52*b* can be arranged inside a vacuum. I. e. the circuit breaker 50 can be a medium voltage vacuum circuit breaker.

The circuit breaker 50 comprises a magnetic actuator 10 that is mechanical connected to the contacts 52*a*, 52*b*, such that the movable plate 32 actuates the circuit breaker 50 by connecting or disconnecting the contacts 52*a*, 52*b* when moving. The circuit breaker 50 can further comprise a spring 54 for generating a force opposite to the movement of the movable plate 32 generated by the activated magnetic field of the magnetic actuator.

While the disclosure has been illustrated and described in detail in the drawings and foregoing description, such illustration and description are to be considered illustrative or exemplary and not restrictive; the disclosure is not limited to the disclosed exemplary embodiments. Other variations to the disclosed exemplary embodiments can be understood and effected by those skilled in the art and practising the claimed disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference symbols in the claims should not be construed as limiting the scope.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 magnetic actuator
12 electromagnet
14 coil
16 core
18 central part

20 permanent magnet
22*a*, 22*b* flank
24 beam
26*a*, 26*b* groove
28*a*, 28*b* section of coil
30 axis
32 moving plate
34*a*, 34*b* position locker
36*a*, 36*b* section of coil
38 locking part
40 connection part
42 screw
44 hole
50 circuit breaker
52*a*, 52*b* electrical contacts
54 spring

What is claimed is:

1. A magnetic actuator for a circuit breaker arrangement, the magnetic actuator comprising:

a coil;

a core with at least one groove for accommodating a section of the coil;

a movable plate configured to be attracted by the core such that when a magnetic field is generated by the coil, the movable plate actuates the circuit breaker arrangement based on the attraction to the core;

a fixed axis member extending axially through the movable plate, and wherein the fixed axis member extends through a central part of the core and is fixed to the core such that the movable plate can only move towards the core and away from the core; and a position locker for locking the coil in the at least one groove, wherein first and second grooves are formed between upper parts of a first flank and a central part of the core, and a second flank and the central part of the core, respectively, and wherein the first groove is limited by an inner side of the upper part of the first flank and a side of the upper part of the central part facing the side of the first flank, and the position locker has a locking part protruding away from the core and over a section of the coil not accommodated in the at least one groove.

2. The magnetic actuator according to claim 1, wherein the position locker is connected to the core with a connection means also used for connecting the position locker to a further member of the circuit breaker arrangement.

3. The magnetic actuator according to claim 1, wherein the position locker has a connection part for connecting the position locker to the core, and the connection part and the locking part are orthogonal with respect to each other.

4. The magnetic actuator according to claim 1, wherein the position locker is L-shaped.

5. The magnetic actuator according to claim 1, wherein the position locker is made of a plate-like material.

6. The magnetic actuator according to claim 1, wherein the position locker is integrally formed.

7. The magnetic actuator according to claim 1, wherein the position locker is made of a non-magnetic material.

8. The magnetic actuator according to claim 1, wherein the position locker is a first position locker situated at a first side of the core, the magnetic actuator comprising:

a second position locker situated at a second side of the core.

9. A method of assembling a magnetic actuator for a circuit breaker arrangement, the method comprising:

setting a coil into a pair of grooves of a core of the magnetic actuator, such that a section of the coil is accommodated in the groove, and wherein the core of the magnetic actuator has a fixed axis member extending axially through a movable plate, and wherein the fixed axis member extends through a central part of the core and is fixed to the core, and wherein the axis member is configured to receive and guide the movable plate only towards the core and away from the core;

pushing a position locker between the coil and the core, wherein first and second grooves are formed between upper parts of a first flank and a central part of the core, and a second flank and the central part of the core, respectively, and wherein the first groove is limited by an inner side of the upper part of the first flank and a side of the upper part of the central part facing the side of the first flank, such that a locking part of the position locker protrudes away from the core and over the coil at a section of the coil not accommodated in the pair of grooves;

attaching a connection part of the position locker to the core, such that the coil is prevented from leaving the pair of grooves by the locking part; and positioning the moveable plate on the axis member.

10. A circuit breaker arrangement comprising:

at least one magnetic actuator including:

a coil;

a core with at least one groove for accommodating a section of the coil;

a movable plate configured to be attracted by the core such that when a magnetic field is generated by the coil, the movable plate actuates the circuit breaker arrangement based on the attraction to the core;

a fixed axis member extending axially through the movable plate, and wherein the fixed axis member extends through a central part of the core and is fixed to the core such that the movable plate can only move towards the core and away from the core;

a position locker for locking the coil in the at least one groove, wherein first and second grooves are formed between upper parts of a first flank and a central part of the core, and a second flank and the central part of the core, respectively, and wherein the first groove is limited by an inner side of the upper part of the first flank and a side of the upper part of the central part facing the side of the first flank, and the position locker has a locking part protruding away from the core and over a section of the coil not accommodated in the groove; and a first electrical contact and a second electrical contact, wherein the at least one magnetic actuator is mechanically connected to the first and second electrical contacts, such that, when moving, the movable plate actuates the circuit breaker arrangement by connecting or disconnecting the first and second contacts.

11. The circuit breaker arrangement according to claim 10, wherein the position locker of the at least one magnetic actuator is connected to the core with a connection means also used for connecting the position locker to a further member of the circuit breaker arrangement.

12. The circuit breaker arrangement according to claim 10, wherein the position locker of the at least one magnetic actuator has a connection part for connecting the position locker to the core, and the connection part and the locking part are orthogonal with respect to each other.

13. The circuit breaker arrangement according to claim 10, wherein the position locker of the at least one magnetic actuator is L-shaped.

14. The circuit breaker arrangement according to claim 10, wherein the position locker of the at least one magnetic actuator is made of a plate-like material.

15. The circuit breaker arrangement according to claim 10, wherein the position locker of the at least one magnetic actuator is integrally formed.

16. The circuit breaker arrangement according to claim 10, wherein the position locker of the at least one magnetic actuator is made of a non-magnetic material.

17. The circuit breaker arrangement according to claim 10, wherein the position locker of the at least one magnetic actuator is a first position locker situated at a first side of the core, and the at least one magnetic actuator magnetic actuator includes a second position locker situated at a second side of the core.

18. The magnetic actuator according to claim 1, wherein the second groove is limited by an inner side of the upper part of the second flank and a side of the upper part of the central part facing the side of the second flank.

19. The method according to claim 9, wherein the second groove is limited by an inner side of the upper part of the second flank and a side of the upper part of the central part facing the side of the second flank.

20. The circuit breaker arrangement according to claim 10, wherein the second groove is limited by an inner side of the upper part of the second flank and a side of the upper part of the central part facing the side of the second flank.

* * * * *